US007423627B2

(12) United States Patent
Mizumaki

(10) Patent No.: US 7,423,627 B2
(45) Date of Patent: Sep. 9, 2008

(54) DATA HOLDING DISPLAY APPARATUS, DRIVING METHOD THEREOF, AND TELEVISION SET

(75) Inventor: Hidetaka Mizumaki, Mie (JP)

(73) Assignee: Sharp Kabushiki Kaisha, Osaka (JP)

( * ) Notice: Subject to any disclaimer, the term of this patent is extended or adjusted under 35 U.S.C. 154(b) by 1149 days.

(21) Appl. No.: 10/761,248

(22) Filed: Jan. 22, 2004

(65) Prior Publication Data

US 2004/0196254 A1 Oct. 7, 2004

(30) Foreign Application Priority Data

Apr. 3, 2003 (JP) ..... 2003-100725

(51) Int. Cl.
*G09G 3/36* (2006.01)

(52) U.S. Cl. ..... 345/103; 345/100

(58) Field of Classification Search ..... 345/103, 345/100, 903

See application file for complete search history.

(56) References Cited

U.S. PATENT DOCUMENTS 5,668,569 A * 9/1997 Greene et al. ..... 345/103
6,396,469 B1 5/2002 Miwa et al.
6,545,653 B1 * 4/2003 Takahara et al. ..... 345/87
2002/0154089 A1 * 10/2002 Yamazaki et al. ..... 345/103

* cited by examiner

*Primary Examiner*—Richard Hjerpe
*Assistant Examiner*—Shaheda A Abdin
(74) *Attorney, Agent, or Firm*—Harness, Dickey & Pierce, P.L.C.

(57) ABSTRACT

A display apparatus has a display area which is divided into first and second display sections that can be independently driven in a scan direction and scanned collaterally. A control circuit controls signal line driving circuits such that the scanning signal lines of the respective display sections are sequentially selected during a plurality of time periods in one frame and the respective display sections are repeatedly scanned in one cycle as many times as the number of the time periods. The signal line driving circuits are supplied with one of the display data and interpolation display data during at least one time period, whereas supplied with the other one of the display data and the interpolation display data during at least one other time period. This ensures to avoid the reduction of brightness and to improve the display quality of moving images.

41 Claims, 8 Drawing Sheets

DATA HOLDING DISPLAY APPARATUS, DRIVING METHOD THEREOF, AND TELEVISION SET

This nonprovisional application claims priority under 35 U.S.C. § 119(a) on Patent Application No.2003-100725 filed in Japan on Apr. 3, 2003, the entire contents of which are hereby incorporated by reference.

FIELD OF THE INVENTION

The present invention relates to a display apparatus using display devices that can hold data, and particularly relates to a technique for improving moving image performance of a display apparatus having group of display devices that are arranged in a matrix manner.

BACKGROUND OF THE INVENTION

In a conventional display apparatus such as a TV set, CRT (Cathode Ray Tube) has prevailed. Recently, however, the performances such as viewing angle, contrast, color reproducibility has been improved apart from space saving and power saving features. A liquid crystal display apparatus of matrix type is successor to the CRTs.

The liquid crystal display apparatus of matrix type has a display area provided with a plurality of scanning signal lines, a plurality of data signal lines that are provided so as to be perpendicular to and to intersect with the scanning signal lines, TFTs (Thin Film Transistors) as control switches each provided at each intersection of the scanning signal lines and the data signal lines. The liquid crystal display apparatus is further provided with (a) a scanning signal line driving circuit (gate driver) for outputting the scanning signals to the scanning signal lines, (b) a data signal line driving circuit (data driver) for outputting to the data signal lines the display signals corresponding to display data, and (c) a control circuit (controller) for controlling the scanning signal line driving circuit and the data signal line driving circuit, respectively. With the arrangement, the display signal is applied to a pixel electrode connected to the TFT that has been selected in response to the scanning signal, so as to control the alignment of the liquid crystal pixels in response to the difference of voltages between the pixel electrode and the opposed electrode.

The liquid crystal is capacitive load. On this account, when a display signal voltage is applied to the pixel electrode, the liquid crystal has the holding property in which the alignment, varying depending on the display signal voltage thus applied, is held. Because of this property, unlike the CRT, it is possible to obtain a display screen without flickering, unlike the CRT. On the other hand, the response speed of the liquid crystal itself, especially the response to halftone is not enough in one frame period of image input signal, thereby arising the problem that the residual image is found in the moving image.

Further, in the liquid crystal display apparatus, the display signal, which has been written into a corresponding pixel, keeps to be held during a time period in which the TFT is not selected. On this account, even if the response speed of the liquid crystal is made fast, the residual image exists on the retina. This is because human being follows one's eyes to the moving image. Thus, another problem arises that the display quality deteriorates.

In view of the circumstances, the following liquid crystal method is proposed in the Japanese unexamined patent publication No. 11-109921 (publication date: Apr. 23, 1999) which corresponds to U.S. Pat. No. (USP 6,396,469 B1), so as to solve the foregoing problems.

According to the arrangement disclosed in the publication, a screen is divided into upper and lower screens (a) such that the signal scanning for the upper screen and a black signal (blanking) scanning for the lower screen are simultaneously carried out during the first half of one frame period, and (b) such that the signal scanning for the lower screen and a black signal (blanking) scanning for the upper screen are simultaneously carried out during the second half of the one frame period.

With the arrangement, when focusing attention on a specific pixel, it is inevitable that both image display period and black display period exist in one frame period. Especially, the existence of the black display period ensures that the image can be displayed without mixing the prior and subsequent frame data. It is possible to improve the display performance of moving image, accordingly.

The conventional arrangement, however, results in that the black display is always carried out on either one of the upper and lower screens in one frame period, thereby causing that the entire brightness of the display screen is lowered.

SUMMARY OF THE INVENTION

The present invention is made for solving the foregoing problems, and its object is to provide a data holding display apparatus, a driving method thereof, and a television set each of which can avoid that the display quality is lowered due to the residual image found in the case of moving image display.

In order to achieve the object, a data holding display apparatus of the present invention includes (a) a display panel of data holding type, which is divided into a plurality of display sections each is capable of being independently driven, and in which a display signal is written into data signal lines connected to pixels of the display section that have been selected; (b) a plurality of data signal line driving circuits, provided for the respective display sections, for supplying the data signal line with the display signal corresponding to inputted display data; and (c) a control circuit for supplying each of the data signal line driving circuits with either one of the display data corresponding to input image signal and interpolation display data prepared in accordance with the input image signal during at least one time period among a plurality of time periods in one cycle in a displaying of the display panel, whereas supplying the each of the data signal line driving circuits with the other one of the display data and the interpolation display data during at least one other time period among the plurality of time periods.

With the arrangement, the data signal line driving circuits in the respective display sections are supplied with either one of the display data corresponding to an input image signal and interpolation display data prepared in accordance with the input image signal during at least one time period among a plurality of time periods in one cycle in a displaying of the display panel, whereas supplied with the other one of the display data and the interpolation display data during at least one other time period among the plurality of time periods. This gives rise to the result that the interpolation display data is written into the display section(s) other than the display section(s) into which the display data corresponding to the input image signal is written.

The reset of display can be made with respect to display section(s) because the interpolation display data is written into such display section(s) other than the display section(s) into which the display data corresponding to the input image signal is written. This makes it possible to restrain that the display quality of moving image is deteriorated due to the fact that a same display data has been held by a same pixel for a long period of time.

Further, it is possible to avoid that the brightness on a display screen is lowered, which occurs when the interpolation display data is merely set to a black display data. This is because the interpolation display data is prepared in accordance with the input image signal.

Another data holding display apparatus in accordance with the present invention includes: (a) a display panel of data holding type for displaying a display signal, the display panel including: a plurality of scanning signal lines; a plurality of data signal lines provided so as to intersect with the scanning signal lines; and pixels provided in a matrix manner at respective intersections of the scanning signal lines and the data signal lines, the display panel having a display area which is divided, in a direction where the scanning signal lines are provided, into a plurality of display sections each capable of being independently driven, and in the display panel the display signal being written into data signal lines connected to pixels of the display section that have been selected, (b) scanning signal line driving circuit for sequentially selecting the scanning signal lines; (c) data signal line driving circuits, provided for the respective display sections, for supplying the data signal lines with the display signal corresponding to inputted display data; and (d) a control circuit for (1) controlling the scanning signal line driving circuit such that the scanning signal lines in the respective display sections are scanned collaterally and the scanning signal lines in the respective display sections are sequentially selected during a plurality of time periods of one cycle in a displaying of the display panel, so as to repeatedly scan the respective display sections in the one cycle as many times as the number of the time periods, and (2) supplying the data signal line driving circuits of the respective display sections with either one of the display data corresponding to an input image signal and an interpolation display data prepared in accordance with the input image signal during at least one of the time periods whereas with the other during at least one other time period.

With the arrangement, it is possible to separately drive the display sections, which are obtained by dividing the display area of the display panel, collaterally by the respective data signal line driving circuits that correspond to the display sections. The scanning signal lines of the respective display sections are sequentially selected during the plural time periods (for example, the number of the time periods is equal to the number of display sections) in one cycle (for example, one frame). This ensures that the respective display sections are repeatedly scanned in the one cycle as many times as the number of the plural time periods. For example, the input image signal is decomposed to so as to correspond to the respective display sections, and the data signal line driving circuits of the respective display sections are supplied with either one of the display data corresponding to an input image signal and an interpolation display data prepared in accordance with the input image signal during at least one of the time periods, whereas supplied with the other during at least one other time period.

Accordingly, it is not necessary in the present data holding display apparatus to scan the scanning signal lines of the respective display sections at a high speed. Because of this, it is possible to secure enough time for writing the display data into the pixel and to secure enough response time of the display panel to the writing.

On the other hand, from the viewpoint of the entire display panel, the double speed driving, i.e., the pseudo-double speed driving is carried out. This makes it possible to restrain that the display quality of moving image is deteriorated due to the fact that a same display data has been held by a same pixel for a long period of time.

Further, the interpolation display data is prepared in accordance with the input image signal. Accordingly, it is possible to avoid that the brightness on a display screen is lowered, which occurs when the interpolation display data is merely set to a black display data.

A further data holding display apparatus in accordance with the present invention includes: (a) a display panel of data holding type for displaying a display signal, the display panel including: a plurality of scanning signal lines; a plurality of data signal lines provided so as to intersect with the scanning signal lines; and pixels provided in a matrix manner at respective intersections of the scanning signal lines and the data signal lines, the display panel having a display area which is divided, in a direction where the scanning signal lines are provided, into a plurality of display sections each capable of being independently driven, and in the display panel the display signal being written into data signal lines connected to pixels of the display section that have been selected, (b) scanning signal line driving circuit for sequentially selecting the scanning signal lines, and (c) data signal line driving circuits, provided for the respective display sections, for supplying the data signal lines with the display signal corresponding to inputted display data, the display area being divided into first and second display sections, the data holding display apparatus further including: (d) a control circuit for (1) controlling the scanning signal line driving circuit such that the scanning signal lines in the first and second display sections are sequentially scanned, respectively, during a first time period and a second time period that is adjacent to the first time period of one cycle in a displaying of the display panel, so as to repeatedly scan the respective first and second display sections twice in the one cycle, and (2) supplying the data signal line driving circuit of the first display section with the display data corresponding to an input image signal during the first time period whereas with an interpolation display data prepared in accordance with the input image signal during the second time period, the control circuit supplying the data signal line driving circuit of the second display section with an interpolation display data prepared in accordance with the input image signal during the first time period whereas with the display data corresponding to the input image signal during the second time period.

With the arrangement, during the first time period of one cycle in a displaying of the display panel, the first display section displays an image corresponding to the input image signal and the second display section displays an interpolation image prepared in accordance with the input image signal, whereas, during the second time period, the first display section displays an interpolation image prepared in accordance with the input image signal and the second display section displays an image corresponding to the input image signal.

Accordingly, it is also not necessary in the present data holding display apparatus to scan the scanning signal lines of the respective display sections at a high speed. Because of this, it is possible to secure enough time for writing the display data into the pixel and to secure enough response time of the display means to the writing.

On the other hand, from the viewpoint of the entire display panel, the double speed driving, i.e., the pseudo-double speed driving is carried out. This makes it possible to restrain that the display quality of moving image is deteriorated due to the fact that a same display data has been held by a same pixel for a long period of time.

Further, the interpolation display data is prepared in accordance with the input image signal. Accordingly, it is possible to avoid that the brightness on a display screen is lowered, which occurs when the interpolation display data is merely set to a black display data.

For a fuller understanding of the nature and advantages of the invention, reference should be made to the ensuing detailed description taken in conjunction with the accompanying drawings.

DESCRIPTION OF THE EMBODIMENTS

The following description deals with one embodiment of the present invention by taking a liquid crystal display apparatus for example with reference to drawings. Note that the display apparatus of the present invention is applicable to a data holding display apparatus, and therefore the present invention is not necessarily limited to the liquid crystal display apparatus.

Figure 1:
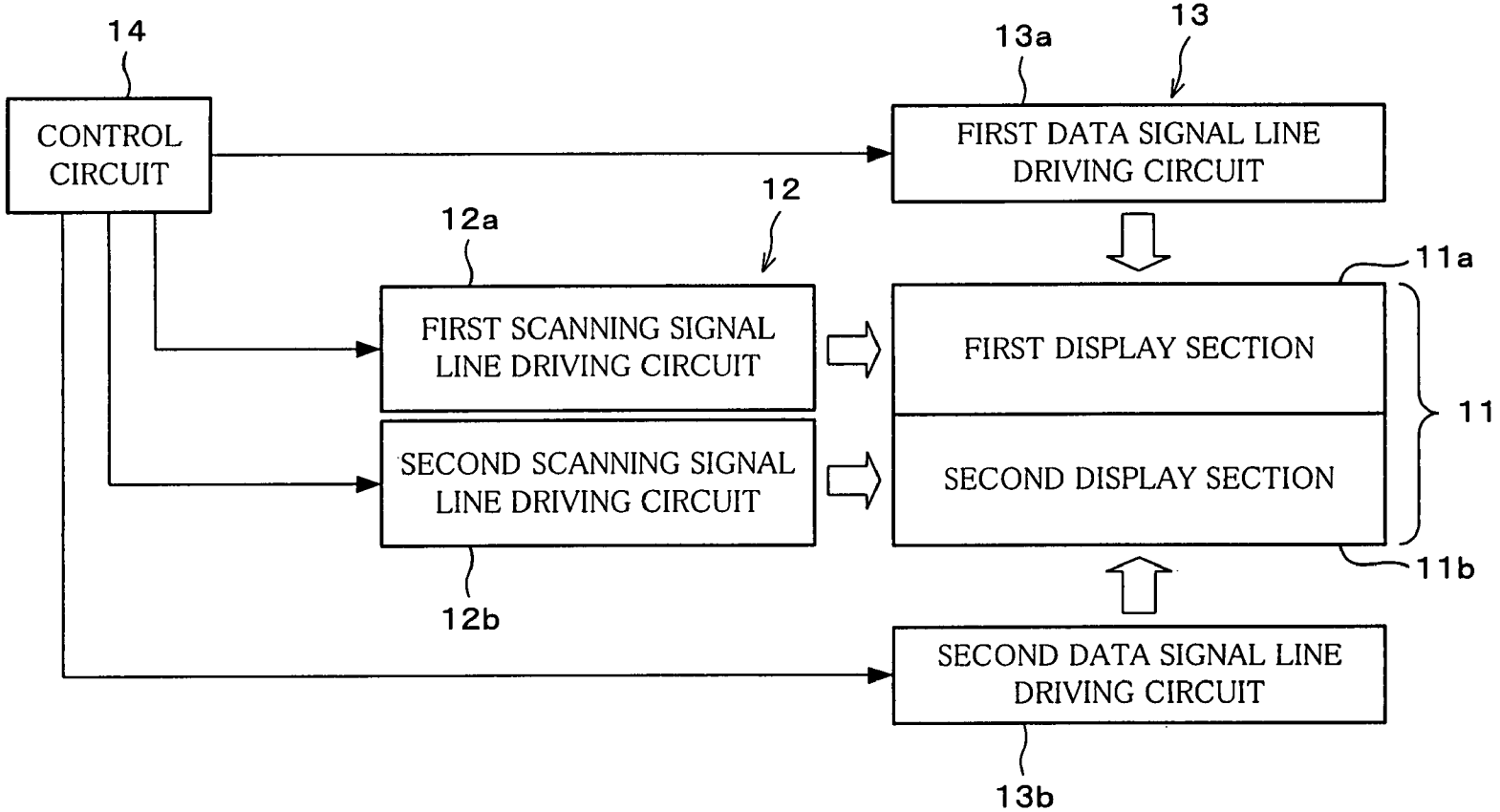
FIG. 1 is a block diagram showing a liquid crystal display apparatus in accordance with one embodiment of the present invention.

FIG. 1 is a view schematically showing a structure of an active matrix liquid crystal display apparatus (hereinafter referred to as liquid crystal display apparatus) in accordance with one embodiment of the present invention. As shown in FIG. 1, the liquid crystal display apparatus includes a display section 11 (display means), a scanning signal line driving circuit 12 (scanning signal line driving means), a data signal line driving circuit 13 (data signal line driving means), and a control circuit 14 (control means).

It is assumed that the display section 11 includes 480 scanning signal lines and 640 data signal lines, for example, according to the present embodiment. The display section 11 is divided into upper and lower display sections, i.e., first and second display sections 11*a* and 11*b*, respectively. The scanning signal lines are perpendicularly provided, respectively. The first display section 11*a* includes 240 scanning signal lines, and the second display sections 11*b* also includes 240 scanning signal lines.

The scanning signal line driving circuit 12 is composed of first and second scanning signal line driving circuits 12*a* and 12*b*. The first scanning signal line driving circuit 12*a* (scanning signal line driving means) sequentially scans the scanning signal lines of the first display section 11*a*. The second scanning signal line driving circuit 12*b* (scanning signal line driving means) sequentially scans the scanning signal lines of the second display section 11*b*.

Note that the scanning signal line driving circuit 12 may be constituted by a single scanning signal line driving circuit. For convenience, this embodiment deals with the case where the scanning signal line driving circuit 12 is composed of the first and second scanning signal line driving circuits 12*a* and 12*b*, respectively. This is for the purpose of making clear how the first and second the display sections 11*a* and 11*b* relate to the scanning signal line driving circuit 12.

The data signal line driving circuit 13 includes first and second signal line driving circuits 13*a* and 13*b*, respectively. The first signal line driving circuit 13*a* (first data signal line driving means) supplies the data signal lines of the first display section 11*a* with the display data. The second signal line driving circuit 13*b* (second data signal line driving means) supplies the data signal lines of the second display section 11*b* with the display data.

The control circuit 14 generates signals/data such as (a) control signals for instructing the timings at which the first and second scanning signal line driving circuits 12*a* and 12*b* should operate, respectively, and (b) display data and display data for use in the interpolation which are essence of the generation of the display signals to supply the first and second signal line driving circuits 13*a* and 13*b*. The control circuit 14 also generates other signals/data and supplies them to their associated circuits.

Figure 2:
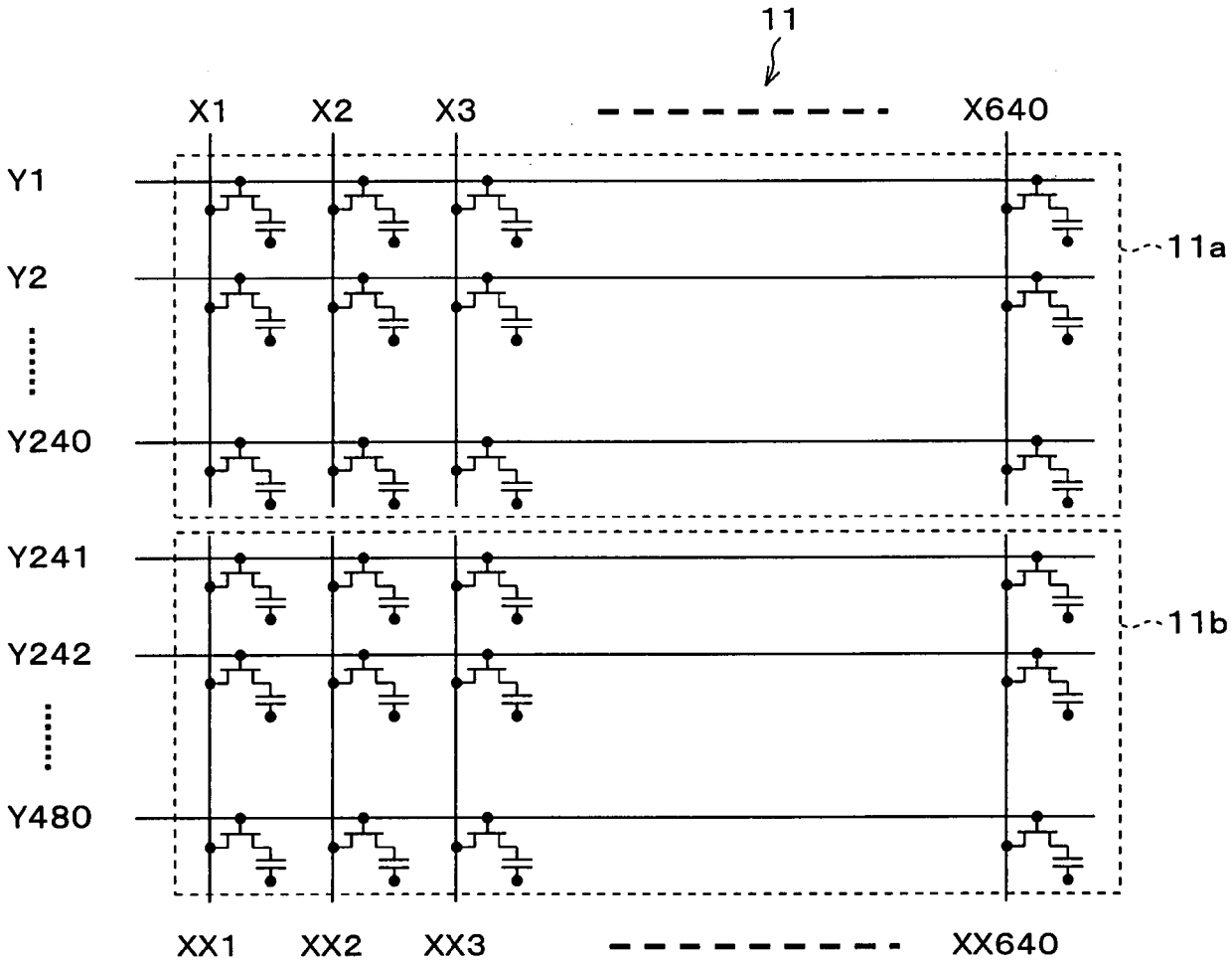
FIG. 2 is a circuit diagram showing an arrangement of a display section shown in FIG. 1.

The first display section 11*a* of the display section 11 includes 240 scanning signal lines Y1 through Y240 and 640 data signal lines X1 through X640 constituting a first data signal line group (see FIG. 2). A pixel is provided at each intersection of the scanning signal lines and the data signal lines. The second display section 11*b* of the display section 11 includes 240 scanning signal lines Y241 through Y480 and 640 data signal lines XX1 through XX640 constituting a second data signal line group. A pixel is provided at each intersection of the scanning signal lines and the data signal lines.

The writing of the display signal into each pixel is carried out by selecting the scanning signal line such that the TFT, connected to the scanning signal line, turns on and then the display signal of the data signal line, connected to the TFT that has turned on, charges the liquid crystal capacity of the pixel.

Here, the first data signal line group is for writing of the display signal into the first display section 11*a*, whereas the second data signal line group is for writing of the display signal into the second display section 11*b*. The first and second data signal line groups include 640 data signal lines, respectively.

Figure 3:
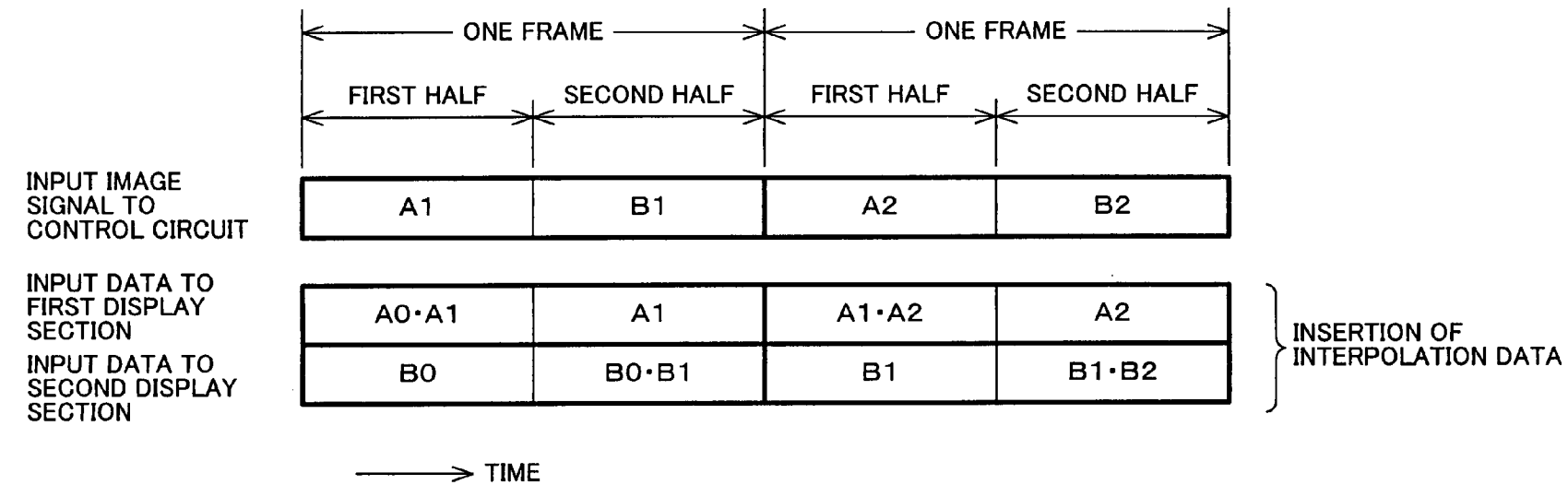
FIG. 3 is an explanatory diagram showing an input image signal supplied to a control circuit shown in FIG. 1 and showing input signals supplied to first and second display sections, respectively.

FIG. 3 is an explanatory view showing image signal (photographic image) and showing display signals corresponding to the image signals that are supplied to the first and second display sections 11*a* and 11*b*, respectively. In FIG. 3, one display period of the input image signal corresponds to one frame.

In FIG. 3, symbol "A" indicates image signal or display data (display signal) corresponding to the first display section 11*a*, and symbol "B" indicates image signal or display data (display signal) corresponding to the second display section 11*b*. The reference numerals written in addition to symbols "A" and "B" indicate frame numbers, respectively. Lower-numbered reference numeral indicates earlier frame. Symbol "A0·A1" that is inputted into the first display section 11*a* in the first half of one frame or symbol "B0·B1" that is inputted into the second display section 11*b* in the second half of the one frame, etc., indicate interpolation display data (interpolation display signal), respectively.

During one frame period, the control circuit 14 receives, as usual in chronological order, the image signal corresponding to the display signal that is supplied to the first display section 11*a* and the image signal corresponding to the display signal that is supplied to the second display section 11*b*.

In contrast, the display signals are simultaneously (collaterally) supplied to the first and second display sections 11*a* and 11*b*. Note that it is preferable that the display signals are simultaneously supplied to the first and second display sections 11*a* and 11*b* because of the reasons such as the easiness of control, but the present invention is not limited to this, provided that the display signals are overlapped in terms of time.

When adopting a conventional technique, the writing of the display signal into the pixel of the display section 11 is carried out once in one frame period. In contrast, according to the present liquid crystal display apparatus, the writings of the display signals into the first and second display sections 11*a* and 11*b* are carried out collaterally in terms of time. This ensures that the display signal is written into the pixel twice during one frame period without changing the writing speed, i.e., without increasing the writing speed. Thus, it is possible in the present liquid crystal display apparatus that the original display signal and other interpolation display signal are written into the pixel during one frame period.

In the example shown in FIG. 3, the interpolation display data "A0·A1" is assigned to the first display section 11*a* in the first half of one frame period and the display data "A1" is assigned to the first display section 11*a* in the second half of the one frame period. In contrast, the display data "B0" is assigned to the second display section 11*b* in the first half of one frame period and the interpolation display data "B0·B1" is assigned to the second display section 11*b* in the second half of the one frame period.

The interpolation display data "A0·A1" is obtained by using (a) the first half section of one frame period of an input image signal that is one frame earlier than a current input image signal and (b) the first half section of one frame period of the current input image signal. The display data "A1" is obtained by using only the first half section of one frame period of the current input image signal.

The display data "B0" is obtained by using only the second half section of one frame period of the input image signal that is one frame earlier than the current input image. The interpolation display data "B0·B1" is obtained by using (a) the second half section of one frame period of the input image signal that is one frame earlier than the current input image signal and (b) the second half section of one frame period of the current input image signal.

The similar relation between the display data of the first display section 11*a* and the display data of the second display section 11*b* is found in other frame periods.

In the present embodiment, the simultaneous writings into the pixels start while the first and second display sections 11*a* and 11*b* are scanned in descending order. Thus, in a single frame, the time difference between the time when the writing into the lowermost scanning signal line Y240 of the first display section 11*a* starts and the time when the writing into the uppermost scanning signal line Y241 of the second display section 11*b* is equal to about 0.5 frame. On this account, it looks like the continuity of the first and second display sections 11*a* and 11*b* is not entirely maintained.

Figure 4:
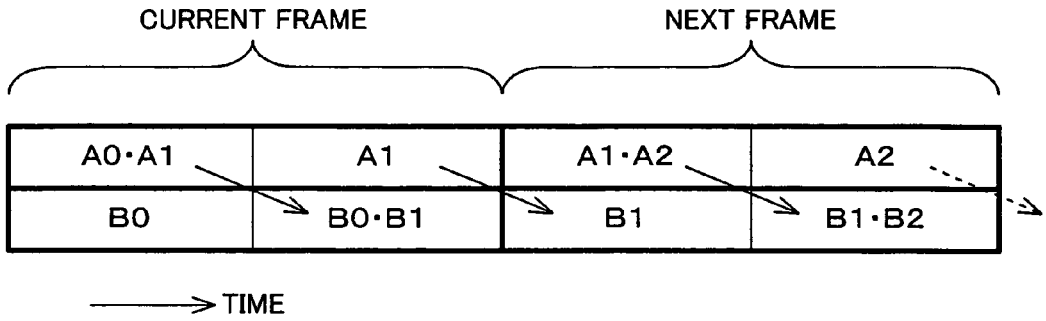
FIG. 4 is an explanatory diagram showing how the respective input signals, supplied to the first and second display sections, are related.

However, according to the display shown in FIG. 3, for example, the continuity of (a) the display data A1 of the first display section 11*a* of the second half of the current frame and (b) the display data B1 of the second display section 11*b* of the first half of the next frame is maintained (see FIG. 4). The continuity of (a) the interpolation display data "A0·A1" of the first display section 11*a* of the first half of the current frame and (b) the interpolation display data "B0·B1" of the second display section 11*b* of the second half of the current frame is almost maintained.

Accordingly, the combination shown in FIG. 3 is preferable for the generation of the display data to reduce the time deviation between (a) the display signal to be supplied to the pixel corresponding to the scanning signal line Y240 (the first display section 11*a*) and (*b*) the display signal to be supplied to the pixel corresponding to the scanning signal line Y241 (the second display section 11*b*). Note that the generation of the display data shown in FIG. 3 is not necessarily required if it is not limited to the case where the scanning signal lines are scanned in descending order.

Figure 5:
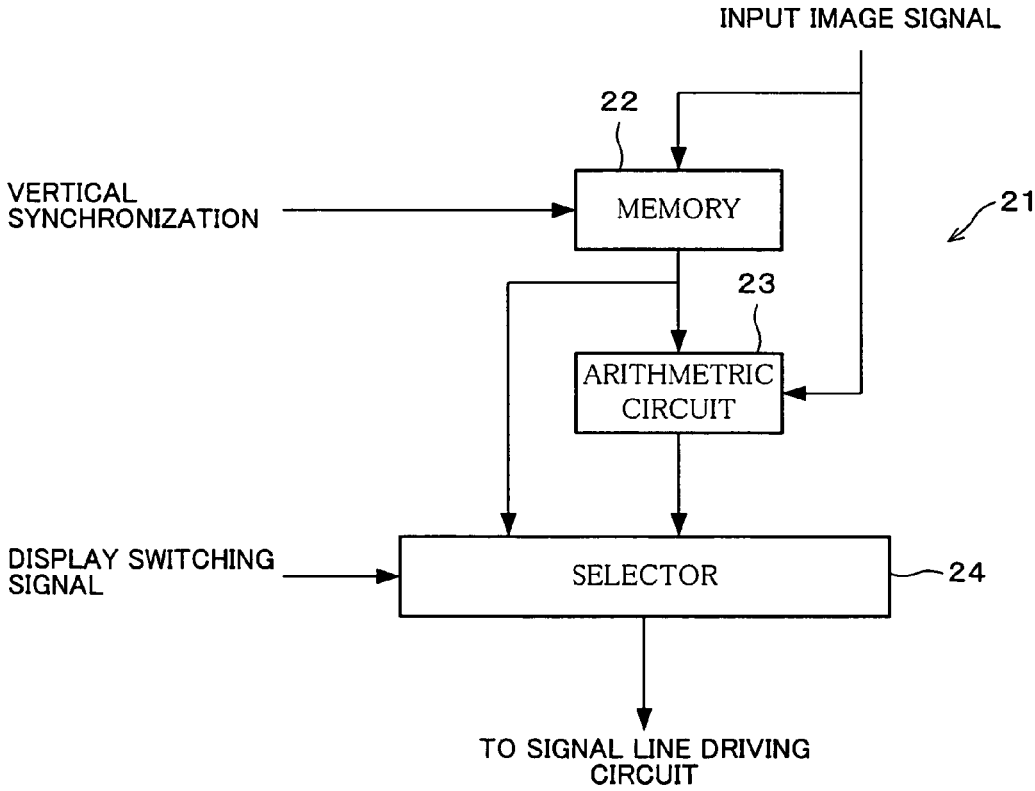
FIG. 5 is a block diagram showing a display data generating section of the control circuit shown in FIG. 1.

FIG. 5 is a block diagram showing an arrangement of a display data generating section 21 in the control circuit 14. The display data generating section 21 generates the display data to supply to the first and second signal line driving circuits 13*a* and 13*b*. The display data generating section 21 includes a memory 22, an arithmetic circuit 23 (arithmetic means), and a selector 24. The memory 22 is not limited to a specific one, provided that it has enough memory capacity to store the input image signal corresponding to the first display section 11*a* or second display section 11*b*. Note that circuits such as flip-flops for correcting the deviations of the respective circuits are omitted from the arrangement shown in FIG. 3, for convenience. Note also that the following description deals with the arrangement of the display data generating section 21 for the first display section 11*a*.

First, the input image signal corresponding to the first display section 11*a* is stored in the memory 22, and is supplied to the arithmetic circuit 23. Vertical synchronization is used as the basis for the operation timings of the memory 22 and the selector 24. Upon being read out from the memory 22, the input image signal that has been stored in the memory 22 is supplied as the display signal to the arithmetic circuit 23 and the selector 24, respectively.

The arithmetic circuit 23 prepares the interpolation display data in accordance with the input image signal and the display data that has been read out from the memory 22, and supplies the selector 24 with the interpolation display data thus prepared. The selector 24 selects either one of the display signal and the interpolation display data in accordance with the timing of a display switching signal which is generated on the basis of the vertical synchronization timing, and supplies the selected signal to the following first signal line driving circuit 13*a* as an output signal.

Note that an arrangement of the display data generating section 21 for the second display section 11*b* is basically similar to that for the first display section 11*a*, except that the timing, for selecting either one of the display data to be supplied to the second signal line driving circuit 13*b* and the interpolation display data, comes 0.5 frame period later after the timing for the first display section 11*a*.

The following description deals with the interpolation display data.

It is preferable that the level (gradation level) of the interpolation display data is an intermediate level between the levels of the respective input image signals of the two target frames to be interpolated. This is because of the purpose of interpolating an inter-frame signal in the display section 11.

When taking the simplification of the arithmetic circuit 23 into consideration, it is preferable that the interpolation display data is an average of the levels of the respective input image signals of the two target frames to be interpolated. This is because the average can be obtained for digital input image signals, merely, by adding the levels of the input image signals of the two frames and by carrying out a bit shift after the addition, thereby ensuring the simplification of the arithmetic circuit 23.

Figure 6:
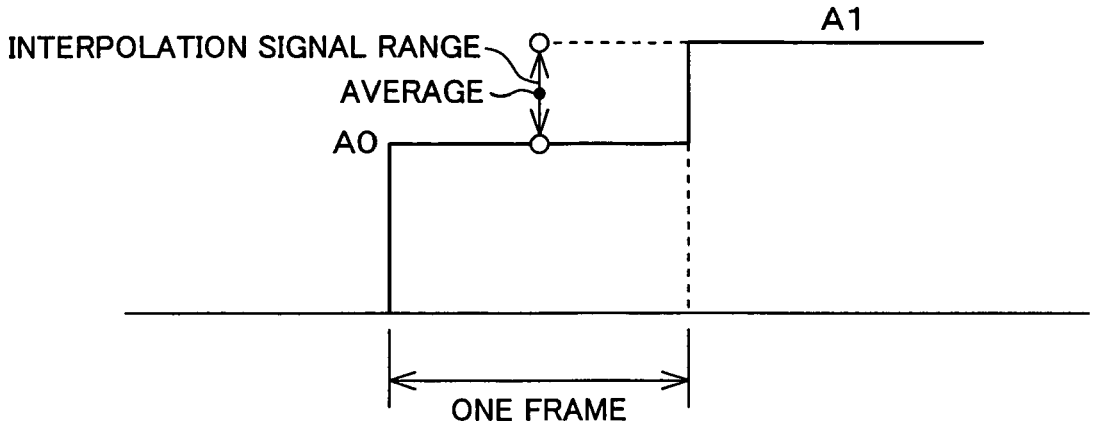
FIG. 6 is an explanatory diagram showing interpolation display data that is generated by the display data generating section shown in FIG. 5.

FIG. 6 is an explanatory diagram showing a range within which the interpolation display data "A0·A1" may fall. In FIG. 6, the range within which the interpolation display data "A0·A1" may fall is denoted as the arrowheads. Namely, it is possible to set the level of the interpolation display data "A0·A1" so as to be greater than the display data A0 and so as to be smaller than the display data A1.

Figure 7:
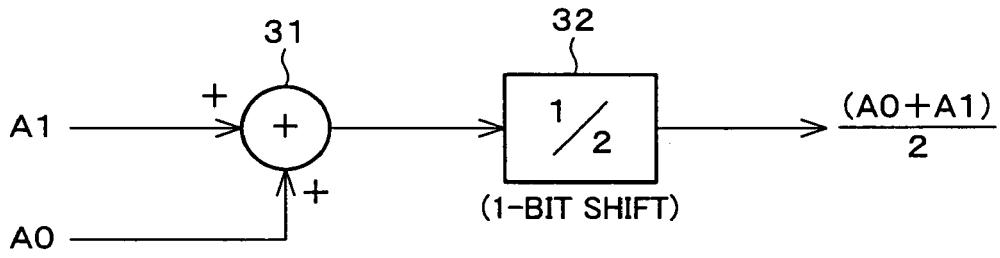
FIG. 7 is a block diagram showing an arrangement in which an arithmetic circuit shown in FIG. 5 outputs an average of a current input image signal (the interpolation display data) and an input image signal corresponding to a previous frame, the current frame coming after such a previous frame.

Ideally, as mentioned above, the level of the interpolation display data is an intermediate level between the levels of the display data A0 and A1. FIG. 7 shows a concrete arrangement of the arithmetic circuit 23 in the case of finding the interpolation display data having the above level.

According to the arrangement shown in FIG. 7, the levels of the respective display data A0 and A1 are added by an adder 31, and then an output signal of the adder 31 is divided by a divider 32, so that one half of the addition of the display data A0 and A1 is obtained. The concrete operation of the divider 32 is to carry out 1-bit shift with respect to the added result of the adder 31.

The present invention is not limited to the case where the level of the interpolation display data is merely the average of the display data A0 and A1. The level of the interpolation display data may be the weighted interpolation display data. The way to weight the interpolation display data may be selectable at the discretion of the circuit designer. For example, the interpolation display data may be weighted in accordance with the direction along which the display data changes. More specifically, in the case of changing from display data A0 of a previous frame to display data A1 of a current frame, the interpolation display data may be weighted in the direction toward the level of the display data A1. The concrete arrangement of the arithmetic circuit 23 for obtaining the interpolation display data thus weighted is shown in FIG. 8.

Figure 8:
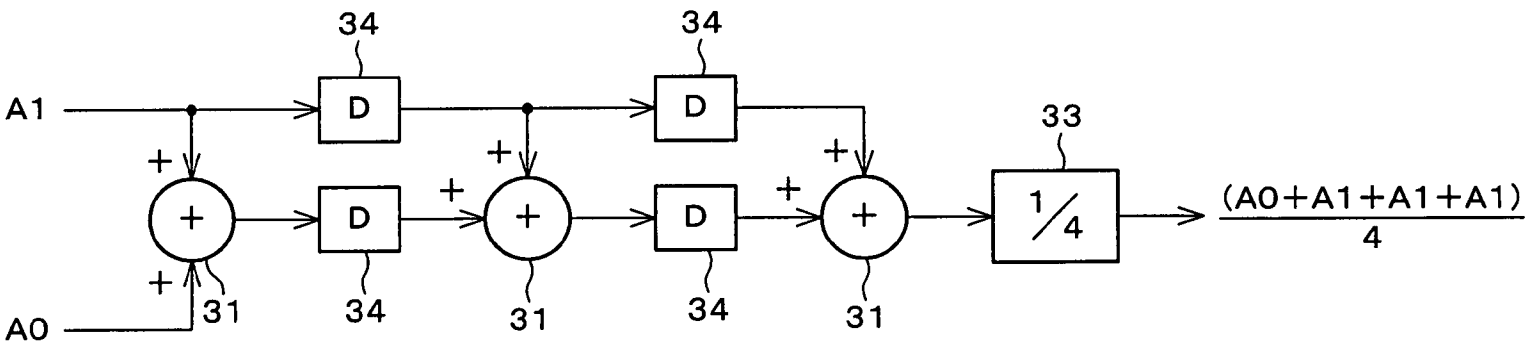
FIG. 8 is a block diagram showing an arrangement in which the arithmetic circuit shown in FIG. 5 outputs the weighted interpolation display data.

According to the arrangement shown in FIG. 8, an adder 31 carries out addition once with respect to the level of the display data A0, whereas three adders 31 carry out addition totally thrice with respect to the level of the display data A1. A divider 33 divides a finally added result, so that one fourth of the added result is obtained. The concrete operation of the divider 33 is to carry out 2-bit shift with respect to the finally added result. D-type flip-flops 34 are provided merely for obtaining of timings.

Figure 9:
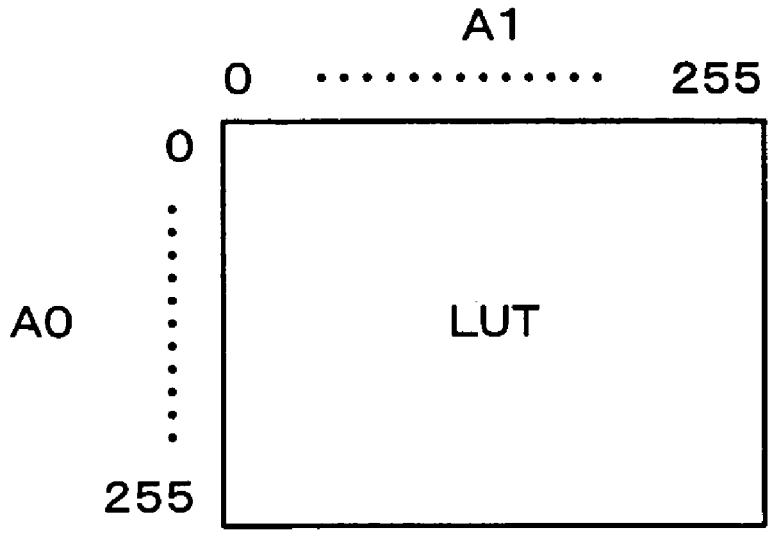
FIG. 9 is a view showing a lookup table used as another arrangement in which the interpolation display data is generated by the display data generating section shown in FIG. 4.

The arrangement of the arithmetic circuit 23 for determining the interpolation display data is not limited to the above arrangement. Other arrangements may be adopted. For example, as shown in FIG. 9, the arrangement in which a look-up table is provided for outputting the interpolation display data "A0·A1" in response to the display data A0 and A1 is used.

As has been described above, in the liquid crystal display apparatus of the present invention, the display section 11 is divided into the first and second display sections 11*a* and 11*b*, respectively, and the first and second display sections 11*a* and 11*b* are driven independently and collaterally. In this case, the display signal corresponding to the input image signal is supplied to one of the first and second display sections 11*a* and 11*b*, for example, the first display section 11*a* (each pixel of the first display section 11*a*) in the first half of one frame period, while the interpolation display signal (interpolation display data) prepared in accordance with the input image signal is supplied to the other of the first and second display sections 11*a* and 11*b*, for example, the second display section 11*b* (each pixel of the second display section 11*b*). For example, the interpolation display signal is prepared in accordance with a current input image signal and an input image signal that is one frame earlier than the current input image signal. In the second half of the one frame period, the display signals (display data) are respectively supplied to the first and second display sections 11*a* and 11*b* in a reverse manner. More specifically, in the second half of one frame period, the interpolation display signal that is prepared in accordance with the input image signal is supplied to the first display section 11*a* (each pixel of the first display section 11*a*), while the display signal corresponding to the input image signal is supplied to the second display section 11*b* (each pixel of the second display section 11*b*).

According to the present liquid crystal display apparatus, the display signal is written at a double speed into the entire display section 11 during one frame period. Namely, the frame frequency becomes twice. This ensures to restrain the blurring of the moving image during the displaying.

Further, according to the present liquid crystal display apparatus, the display signal corresponding to the input image signal is written into one of the display sections, whereas the interpolation display signal that is prepared in accordance with the input image signal is written into the other of the display sections. This ensures to avoid that the brightness of the entire display screen is lowered, unlike the case where the black display signal is merely written.

In addition, although the display signal is written into the display section 11 in its entirety at a double speed, it is not necessary to write the display signal into each of the first and second display sections 11*a* and 11*b* at such a double speed. Accordingly, it is possible to fully secure a response time of the liquid crystal required for writing the display signal.

As mentioned above, it is preferable that the interpolation display signal is prepared in accordance with a current input image signal and an input image signal that is one frame earlier than the current input image signal. The present invention is however not limited to this, provided that the interpolation display data is prepared in accordance with the input image signal.

The foregoing description deals with the case where the display section 11 is divided into two. The present invention is not limited to this. The display section 11 may be divided into three or more sections. In this case, it is necessary to provide signal line driving circuits whose number is equal to the number of the divisions of the display section 11, and it is necessary that the control circuit 14 supplies each of the respective signal line driving circuits with (a) display data corresponding to the input image signal and (b) an interpolation display signal prepared in accordance with the input image signal.

The foregoing description deals with the case where the display signal is written into the display section 11 twice during one frame period. Thrice or more, the display signal may be written into the display section 11 during one frame period. Alternatively, the number of the writing of the display signal into the display section 11 may be determined in accordance with the number of the divisions of the display section 11.

Figure 10:
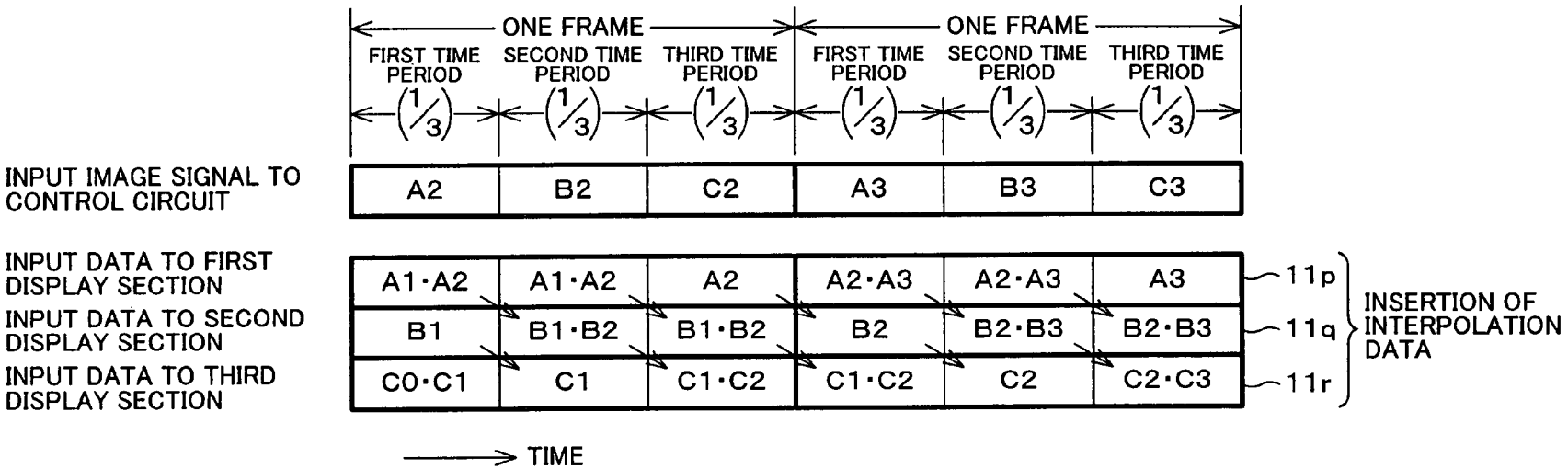
FIG. 10 is an explanatory diagram showing an input image signal supplied to the control circuit and input signals supplied to first and second display sections, respectively, in another arrangement that is different from the arrangement shown in FIG. 3.

FIG. 10 shows the case where (a) the display section 11 is divided into three sections, for example, in such a direction that the scanning signal lines are provided and (b) the number of the writing of the display signal into the display section 11 during one frame period is three, this number being coincident with the number of the divisions of the display section 11.

In FIG. 10, the display section 11 is divided into first through third display sections 11*p* through 11*r*. Each of the first through third display sections 11*p* through 11*r* includes the same number of the scanning signal lines, for example. Like the case shown in FIG. 1, first through third signal line driving circuits are provided so as to correspond to the first through third display sections 11*p* through 11*r*, respectively. One frame period is divided into first through third time periods, each of which has one third of one frame period, for example. In each of the first through third time periods, the control circuit 14 supplies the first through third signal line driving circuits with display data corresponding to an input image signal or with interpolation display data prepared in accordance with the input image signal. This ensures that (a) the display data corresponding to an input image signal or (b) the interpolation display data prepared in accordance with the input image signal is thrice written into each display section during one frame period.

For example, the writing of the display signal into the display section 11 is carried out trice: the input image signal itself (the display signal corresponding to the input image signal) is once written into the display section 11; and the interpolation display signal prepared in accordance with the input image signal is twice written into the display section 11. In this case, it is preferable that the interpolation display signal to be twice written into the display section 11 is generated so as to interpolate between the input image signals, thereby resulting in that the continuity of the image (video picture) is maintained on the display section 11.

More specifically, as shown in FIG. 10, interpolation display data "A1·A2" is assigned for the first display section 11*p* during the first and second time periods in one frame period, whereas interpolation display data "A2" is assigned for the first display section 11*p* during the third time period in one frame period. Interpolation display data "B1" is assigned for the second display section 11*q* during the first time period in one frame period, whereas interpolation display data "B1·B2" is assigned for the second display section 11*q* during the second and third time periods in the one frame period. Interpolation display data "C0·C1" is assigned for the third display section 11*r* during the first time period in one frame period, interpolation display data "C1" is assigned for the second display section 11*r* during the second time period in the one frame period, and interpolation display data "C1·C2" is assigned for the third display section 11*r* during the third time period in the one frame period.

Note that the display data A, B, and C correspond to the first, second, and third display sections 11*p*, 11*q*, and 11*r*, respectively.

In FIG. 10, the continuity of (a) the interpolation display data "A1·A2" in the first display section 11*p* during the first time period of the current frame, (b) the interpolation display data "B1·B2" in the second display section 11*q* during the second time period of the current frame, and (c) the interpolation display data "C1·C2" in the third display section 11*r* during the third time period of the current frame is maintained. The continuity of (a) the interpolation display data "A1·A2" in the first display section 11*p* during the second time period of the current frame, (b) the interpolation display data "B1·B2" in the second display section 11*q* during the third time period of the current frame, and (c) the interpolation display data "C1·C2" in the third display section 11*r* during the first time period of the next frame is maintained. The continuity of (a) the interpolation display data "A2" in the first display section 11*p* during the third time period of the current frame, (b) the interpolation display data "B2" in the second display section 11*q* during the first time period of the next frame, and (c) the interpolation display data "C2" in the third display section 11*r* during the second time period of the next frame is maintained.

The above description deals with the case where the present invention is applied to an active matrix liquid crystal display apparatus. However, the present invention is not limited to this. The present invention may be applied to any data holding active matrix display apparatus.

The present invention is not limited to the respective embodiments. The present invention may be modified in many ways within a range recited in claims. The technical scope of the present invention also includes an embodiment obtained by appropriately combining the technical means disclosed in the above-described different embodiments.

As has been described above, a data holding display apparatus in accordance with the present invention includes: (a) display means of data holding type for displaying a display signal, the display means including: a plurality of scanning signal lines; a plurality of data signal lines provided so as to intersect with the scanning signal lines; and pixels provided in a matrix manner at respective intersections of the scanning signal lines and the data signal lines; the display means having a display area which is divided, in a direction where the scanning signal lines are provided, into a plurality of display sections each capable of being independently driven, and in said display means the display signal being written into data signal lines connected to pixels of the display section that have been selected, (b) scanning signal line driving means for sequentially selecting the scanning signal lines, (c) data signal line driving means, provided for the respective display sections, for supplying the data signal lines with the display signal corresponding to inputted display data, and (d) control means for (1) controlling the scanning signal line driving means such that the scanning signal lines in the respective display sections are scanned collaterally and the scanning signal lines in the respective display sections are sequentially selected during a plurality of time periods of one cycle in a displaying of the display means, so as to repeatedly scan the respective display sections in the one cycle as many times as the number of the time periods, and (2) supplying the data signal line driving means of the respective display sections with either one of the display data corresponding to an input image signal and an interpolation display data prepared in accordance with the input image signal during at least one of the time periods whereas with the other during at least one other time period.

With the arrangement, it is possible to separately drive the display sections, which are obtained by dividing the display area of the display means, collaterally by the respective data signal line driving circuits that correspond to the display sections. The scanning signal lines of the respective display sections are sequentially selected during the plural time periods (for example, the number of the time periods is equal to the number of display sections) in one cycle (for example, one frame). This ensures that the respective display sections are repeatedly scanned in the one cycle as many times as the number of the plural time periods. For example, the input image signal is decomposed to so as to correspond to the respective display sections, and the data signal line driving circuits of the respective display sections are supplied with either one of the display data corresponding to an input image signal and an interpolation display data prepared in accordance with the input image signal during at least one of the time periods, whereas supplied with the other during at least one other time period.

Accordingly, it is not necessary in the present data holding display apparatus to scan the scanning signal lines of the respective display sections at a high speed. Because of this, it is possible to secure enough time for writing the display data into the pixel and to secure enough response time of the display panel to the writing.

On the other hand, from the viewpoint of the entire display panel, the double speed driving, i.e., the pseudo-double speed driving is carried out. This makes it possible to restrain that the display quality of moving image is deteriorated due to the fact that a same display data has been held by a same pixel for a long period of time.

Further, the interpolation display data is prepared in accordance with the input image signal. Accordingly, it is possible to avoid that the brightness on a display screen is lowered, which occurs when the interpolation display data is merely set to a black display data.

In the data holding display apparatus, it may be arranged such that the interpolation display data is prepared in accordance with (a) a current image signal of a current one cycle corresponding to the display section carrying out a display in accordance with the interpolation display data and (b) a neighboring image signal that is one cycle earlier or one cycle later than the current image signal.

With the arrangement, the interpolation display data is prepared in accordance with (a) a current image signal of a current one cycle corresponding to the display section carrying out a display in accordance with the interpolation display data and (b) a neighboring image signal that is one cycle earlier or one cycle later than the current image signal. This ensures that the continuity of a display image corresponding to the input image signal and an interpolation image based on the interpolation display data is substantially maintained. It is possible to reduce residual image while facilitating the displaying, thereby improving the display quality of moving image.

In the data holding display apparatus, it may be arranged such that the interpolation display data has a signal level of (a) greater than a smaller one of the current image signal and the neighboring image signal and of (b) smaller than a greater one of the current image signal and the neighboring image signal, when these image signals are different from each other.

With the arrangement, it is possible to appropriately maintain the continuity of the display image corresponding to the input image signal and the interpolation image corresponding to the interpolation display data. This ensures to improve the facilitation of displaying the moving image.

In the data holding display apparatus, it may be arranged such that the interpolation display data has a signal level of an average of the current image signal and the neighboring image signal.

In the data holding display apparatus, it may be arranged such that the control means includes arithmetic means for calculating and finding the interpolation display data.

With the arrangement, the interpolation display data is found by arithmetic operation based on the display data of one frame in the input image signal and the display data of another frame adjacent to the one frame, for example. On this account, it is possible to restrain and reduce the size of circuits constituting the control means.

In the data holding display apparatus, it may be arranged such that the one cycle in the displaying of the display means is one frame cycle of the input image signal.

With the arrangement, the cycle at which one image of the data holding display apparatus is displayed is one frame cycle. Thus, it is not necessary to provide a memory for synchronizing the input image signal with the interpolation image signal to be displayed in response to the interpolation display data, thereby simplifying the circuits for generating the interpolation image signal.

In the data holding display apparatus, it may be arranged such that a time deviation between the first and second time periods is equal to one half of a frame cycle.

In the driving method of the data holding display apparatus, it may be arranged such that a time deviation between the first and second time periods is equal to one half of a frame cycle.

With the arrangement, in the display area of the display means, the display signal varying depending on the display data corresponding to the input image signal and the display signal varying depending on the interpolation display data have a same mix. This ensures to reduce the residual image, thereby enabling of displaying further excellent moving image.

In the data holding display apparatus, it may be arranged such that a time period required for the scanning signal line driving means to scan the first display section and a time period required for the scanning signal line driving means to scan the second display section are respectively one half of a frame period, and such that the first and second display sections are simultaneously scanned.

In the driving method of the data holding display apparatus, it may be arranged such that a time period required for the scanning signal line driving means to scan the first display section and a time period required for the scanning signal line driving means to scan the second display section are respectively one half of a frame period, and such that the first and second display sections are simultaneously scanned.

With the arrangement, it ensures that the continuity of (a) an image displayed, on the first display section, corresponding to the input image signal and (b) an image, on the second display section, corresponding to the input image signal is maintained. Further, the above two images are written continuously in terms of time into the first and second display sections so as to bridge between the first and second display sections. Thus, it is possible to facilitate the displaying of the images corresponding to the input image signals, with bridging between the first and second display sections.

In the data holding display apparatus, it may be arranged such that one of the interpolation display data supplied to the data signal line driving means of the respective first and second display sections during one frame period is prepared in accordance with a first input image signal which is supplied to the data signal line driving means during one frame period and a second input image signal which is one frame earlier than the first input image signal, and such that the other of the interpolation display data is prepared in accordance with the first input image signal and a third input image signal which is one frame later than the first input image signal.

With the arrangement, in addition to the continuity of the image corresponding to the input image signals, it also ensures that the continuity of (a) an image displayed, on the first display section, corresponding to the interpolation display data and (b) an image, on the second display section, corresponding to the interpolation display data is maintained. Further, the above two images are written continuously in terms of time into the first and second display sections so as to bridge between the first and second display sections. Thus, in addition to the facilitation of the displaying of the images corresponding to the input image signals, it is also possible to facilitate the displaying of the images corresponding to the interpolation display data input image signals, with bridging between the first and second display sections.

As described above, according to the data holding display apparatus in accordance with the present invention, it is possible in the display panel (mainly, liquid crystal display panel) to restrain the lowering of brightness and the deterioration of the display quality of moving image. It is possible to suitably use the present data holding display apparatus in a television set including a liquid crystal display panel.

Further, it is possible to suitably use the present data holding display apparatus in a hand-held device such as PDA (Personal Digital Assistants) or a cellar mobile telephone which includes a liquid crystal display panel and can carry out the displaying of moving image.

The present data holding display apparatus is applicable to any apparatus that can carry out the displaying of moving image.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A data holding display apparatus, comprising:

display means of data holding type for displaying a display signal, said display means being divided into a plurality of display sections each capable of being independently driven, and in said display means the display signal being written into data signal lines connected to pixels of the display section that have been selected;

a plurality of data signal line driving means, provided for the respective display sections, for supplying the data signal line with the display signal corresponding to inputted display data; and control means for supplying each of the data signal line driving means with either one of the display data corresponding to input image signal and interpolation display data prepared in accordance with the input image signal during at least one time period among a plurality of time periods in one cycle in a displaying of said display means, whereas supplying said each of the data signal line driving means with the other one of the display data and the interpolation display data during at least one other time period among the plurality of time periods.

2. The data holding display apparatus as set forth in claim 1, wherein:

said display means has a display area which is divided into first and second display sections;

the plurality of time periods includes first and second time periods; and said control means (a) supplies the data signal line driving means of the first display section with the display data corresponding to the input image signal during the first time period whereas supplies with the interpolation display data prepared in accordance with the input image signal during the second time period, and (b) supplies the data signal line driving means of the second display section with the interpolation display data prepared in accordance with the input image signal during the first time period whereas supplies with the display data corresponding to the input image signal during the second time period.

3. The data holding display apparatus as set forth in claim 2, wherein the interpolation display data is prepared in accordance with (a) a current image signal of a current one cycle corresponding to the display section carrying out a display in accordance with the interpolation display data and (b) a neighboring image signal that is one cycle earlier or one cycle later than the current image signal.

4. The data holding display apparatus as set forth in claim 3, wherein the interpolation display data has a signal level of (a) greater than a smaller one of the current image signal and the neighboring image signal and of (b) smaller than a greater one of the current image signal and the neighboring image signal, when these image signals are different from each other.

5. The data holding display apparatus as set forth in claim 4, wherein the interpolation display data has a signal level of an average of the current image signal and the neighboring image signal.

6. The data holding display apparatus as set forth in claim 1, wherein said control means includes arithmetic means for calculating and finding the interpolation display data.

7. The data holding display apparatus as set forth in claim 1, wherein the one cycle in the displaying of said display means is one frame cycle of the input image signal.

8. The data holding display apparatus as set forth in claim 1, wherein the plurality of time periods includes first and second time periods, and a time deviation between the first and second time periods is equal to one half of a frame cycle.

9. The data holding display apparatus as set forth in claim 8, wherein:

said display area is divided into first and second display sections;

a time period required for the scanning signal line driving means to scan the first display section and a time period required for the scanning signal line driving means to scan the second display section are respectively one half of a frame period; and the first and second display sections are simultaneously scanned.

10. The data holding display apparatus as set forth in claim 9, wherein:

one of the interpolation display data supplied to the data signal line driving means of the respective first and second display sections during one frame cycle is prepared in accordance with a first input image signal which is supplied to the data signal line driving means during one frame cycle and a second input image signal which is one frame earlier than the first input image signal; and the other of the interpolation display data is prepared in accordance with the first input image signal and a third input image signal which is one frame later than the first input image signal.

11. A television set comprising a data holding display apparatus, said data holding display apparatus including:

display means of data holding type, which is divided into a plurality of display sections each is capable of being independently driven, and into which a display signal is written into data signal lines connected to pixels of the display section that have been selected;

a plurality of data signal line driving means, provided for the respective display sections, for supplying the data signal line with the display signal corresponding to inputted display data; and control means for supplying each of the data signal line driving means with either one of the display data corresponding to input image signal and interpolation display data prepared in accordance with the input image signal during at least one time period among a plurality of time periods in one cycle in a displaying of said display means, whereas supplying said each of the data signal line driving means with the other one of the display data and the interpolation display data during at least one other time period among the plurality of time periods.

12. A data holding display apparatus, comprising:

display means of data holding type for displaying a display signal, said display means including:

a plurality of scanning signal lines;

a plurality of data signal lines provided so as to intersect with the scanning signal lines; and pixels provided in a matrix manner at respective intersections of the scanning signal lines and the data signal lines;

said display means having a display area which is divided, in a direction where the scanning signal lines are provided, into a plurality of display sections each capable of being independently driven, and in said display means the display signal being written into data signal lines connected to pixels of the display section that have been selected, scanning signal line driving means for sequentially selecting the scanning signal lines, data signal line driving means, provided for the respective display sections, for supplying the data signal lines with the display signal corresponding to inputted display data, and control means for (a) controlling the scanning signal line driving means such that the scanning signal lines in the respective display sections are scanned collaterally and the scanning signal lines in the respective display sections are sequentially selected during a plurality of time periods of one cycle in a displaying of the display means, so as to repeatedly scan the respective display sections in the one cycle as many times as the number of the time periods, and (b) supplying the data signal line driving means of the respective display sections with either one of the display data corresponding to an input image signal and an interpolation display data prepared in accordance with the input image signal during at least one of the time periods whereas with the other during at least one other time period.

13. The data holding display apparatus as set forth in claim 12, wherein:

the interpolation display data is prepared in accordance with (a) a current image signal of a current one cycle corresponding to the display section carrying out a display in accordance with the interpolation display data and (b) a neighboring image signal that is one cycle earlier or one cycle later than the current image signal.

14. The data holding display apparatus as set forth in claim 13, wherein the interpolation display data has a signal level of (a) greater than a smaller one of the current image signal and the neighboring image signal and of (b) smaller than a greater one of the current image signal and the neighboring image signal, when these image signals are different from each other.

15. The data holding display apparatus as set forth in claim 14, wherein the interpolation display data has a signal level of an average of the current image signal and the neighboring image signal.

16. The data holding display apparatus as set forth in claim 12, wherein said control means includes arithmetic means for calculating and finding the interpolation display data.

17. The data holding display apparatus as set forth in claim 12, wherein the one cycle in the displaying of said display means is one frame cycle of the input image signal.

18. A television set, comprising a data holding display apparatus, said data holding display apparatus including:

display means of data holding type for displaying a display signal, said display means including:

a plurality of scanning signal lines;

a plurality of data signal lines provided so as to intersect with the scanning signal lines; and pixels provided in a matrix manner at respective intersections of the scanning signal lines and the data signal lines;

said display means having a display area which is divided, in a direction where the scanning signal lines are provided, into a plurality of display sections each capable of being independently driven, and in said display means the display signal being written into data signal lines connected to pixels of the display section that have been selected, scanning signal line driving means for sequentially selecting the scanning signal lines, data signal line driving means, provided for the respective display sections, for supplying the data signal lines with the display signal corresponding to inputted display data, and control means for (a) controlling the scanning signal line driving means such that the scanning signal lines in the respective display sections are scanned collaterally and the scanning signal lines in the respective display sections are sequentially selected during a plurality of time periods of one cycle in a displaying of the display means, so as to repeatedly scan the respective display sections in the one cycle as many times as the number of the time periods, and (b) supplying the data signal line driving means of the respective display sections with either one of the display data corresponding to an input image signal and an interpolation display data prepared in accordance with the input image signal during at least one of the time periods whereas with the other during at least one other time period.

19. A data holding display apparatus, comprising:

display means of data holding type for displaying a display signal, said display means including:

a plurality of scanning signal lines;

a plurality of data signal lines provided so as to intersect with the scanning signal lines; and pixels provided in a matrix manner at respective intersections of the scanning signal lines and the data signal lines;

said display means having a display area which is divided, in a direction where the scanning signal lines are provided, into a plurality of display sections each capable of being independently driven, and in said display means the display signal being written into data signal lines connected to pixels of the display section that have been selected, scanning signal line driving means for sequentially selecting the scanning signal lines, and data signal line driving means, provided for the respective display sections, for supplying the data signal lines with the display signal corresponding to inputted display data, the display area being divided into first and second display sections, said data holding display apparatus, further comprising:

control means for (a) controlling the scanning signal line driving means such that the scanning signal lines in the first and second display sections are respectively scanned during a first time period and a second time period that is adjacent to the first time period of one cycle in a displaying of the display means, so as to repeatedly scan the respective first and second display sections twice in the one cycle, and (b) supplying the data signal line driving means of the first display section with the display data corresponding to an input image signal during the first time period whereas with an interpolation display data prepared in accordance with the input image signal during the second time period, said control means supplying the data signal line driving means of the second display section with an interpolation display data prepared in accordance with the input image signal during the first time period whereas with the display data corresponding to the input image signal during the second time period.

20. The data holding display apparatus as set forth in claim 19, wherein the interpolation display data is prepared in accordance with (a) a current image signal of a current one cycle corresponding to the display section carrying out a display in accordance with the interpolation display data and (b) a neighboring image signal that is one cycle earlier or one cycle later than the current image signal.

21. The data holding display apparatus as set forth in claim 20, wherein the interpolation display data has a signal level of (a) greater than a smaller one of the current image signal and the neighboring image signal and of (b) smaller than a greater one of the current image signal and the neighboring image signal, when these image signals are different from each other.

22. The data holding display apparatus as set forth in claim 21, wherein the interpolation display data has a signal level of an average of the current image signal and the neighboring image signal.

23. The data holding display apparatus as set forth in claim 19, wherein said control means includes arithmetic means for calculating and finding the interpolation display data.

24. The data holding display apparatus as set forth in claim 19, wherein the one cycle in the displaying of said display means is one frame cycle of the input image signal.

25. The data holding display apparatus as set forth in claim 19, wherein a time deviation between the first and second time periods is equal to one half of a frame cycle.

26. The data holding display apparatus as set forth in claim 25, wherein:

a time period required for the scanning signal line driving means to scan the first display section and a time period required for the scanning signal line driving means to scan the second display section are respectively one half of a frame period; and the first and second display sections are simultaneously scanned.

27. The data holding display apparatus as set forth in claim 26, wherein:

one of the interpolation display data supplied to the data signal line driving means of the respective first and second display sections during one frame cycle is prepared in accordance with a first input image signal which is supplied to the data signal line driving means during one frame cycle and a second input image signal which is one frame earlier than the first input image signal; and the other of the interpolation display data is prepared in accordance with the first input image signal and a third input image signal which is one frame later than the first input image signal.

28. A television set, comprising a data holding display apparatus, said data holding display apparatus including:

display means of data holding type for displaying a display signal, said display means including:

a plurality of scanning signal lines;

a plurality of data signal lines provided so as to intersect with the scanning signal lines; and pixels provided in a matrix manner at respective intersections of the scanning signal lines and the data signal lines, said display means having a display area which is divided, in a direction where the scanning signal lines are provided, into a plurality of display sections each capable of being independently driven, and in which the display signal is written into data signal lines connected to pixels of the display section that have been selected, scanning signal line driving means for sequentially selecting the scanning signal lines, and data signal line driving means, provided for the respective display sections, for supplying the data signal lines with the display signal corresponding to inputted display data, the display area being divided into first and second display sections, said data holding display apparatus, further comprising:

control means for (a) controlling the scanning signal line driving means such that the scanning signal lines in the first and second display sections are sequentially scanned during a first time period and a second time period that is adjacent to the first time period of one cycle in a displaying of the display means, so as to repeatedly scan the respective first and second display sections twice in the one cycle, and (b) supplying the data signal line driving means of the first display section with the display data corresponding to an input image signal during the first time period whereas with an interpolation display data prepared in accordance with the input image signal during the second time period, said control means supplying the data signal line driving means of the second display section with an interpolation display data prepared in accordance with the input image signal during the first time period whereas with the display data corresponding to the input image signal during the second time period.

29. A driving method of a data holding display apparatus, comprising the steps of:

using display means of data holding type, which is divided into a plurality of display sections each capable of being independently driven, and into which a display signal is written into data signal lines connected to pixels of the display section that have been selected; and supplying each of the display sections with either one of the display data corresponding to input image signal and interpolation display data prepared in accordance with the input image signal during at least one time period among a plurality of time periods in one cycle in a displaying of said display means, whereas supplying said each of the display sections with the other one of the display data and the interpolation display data during at least one other time period among the time periods.

30. The driving method as set forth in claim 29, wherein:

said display means has a display area which is divided into first and second display sections, the first display section is supplied with the display signal corresponding to an input image signal during the first time period whereas with an interpolation display signal prepared in accordance with the input image signal during the second time period, and the second display section is supplied with an interpolation display signal prepared in accordance with the input image signal during the first time period whereas with the display signal corresponding to the input image signal during the second time period.

31. The driving method as set forth in claim 30, wherein a time deviation between the first and second time periods is equal to one half of a frame cycle.

32. The driving method as set forth in claim 31, wherein:

a time period required for scanning the first display section and a time period required for scanning the second display section are respectively one half of a frame period; and the first and second display sections are simultaneously scanned.

33. A driving method of a data holding display apparatus, comprising the steps of:

using display means of data holding type for displaying a display signal, said display means having a display area which is divided, in a direction where the scanning signal lines are provided, into a plurality of display sections each capable of being independently driven, and in said display means the display signal being written into data signal lines connected to pixels of the display section that have been selected;

scanning the scanning signal lines in the respective display sections collaterally and sequentially selecting the scanning signal lines in the respective display sections during a plurality of time periods of one cycle in a displaying of the display means, so as to repeatedly scan the respective display sections in the one cycle as many times as the number of the time periods; and supplying the respective display sections with either one of the display data corresponding to an input image signal and an interpolation display data prepared in accordance with the input image signal during at least one of the time periods whereas with the other during at least one other time period.

34. The driving method as set forth in claim 33, wherein the display area of the display means is divided into first and second display sections, said method further comprising the steps of:

sequentially selecting the scanning signal lines in the first and second display sections, respectively, during a first time period and a second time period that is adjacent to the first time period of one cycle in a displaying of the display means, so as to repeatedly scan the respective first and second display sections twice in the one cycle;

supplying the first display section with a display signal corresponding to the input image signal during the first time period whereas with an interpolation display data prepared in accordance with the input image signal during the second time period; and supplying the second display section with an interpolation display signal prepared in accordance with the input image signal during the first time period whereas with the display signal corresponding to the input image signal during the second time period.

35. The driving method as set forth in claim 34, wherein a time deviation between the first and second time periods is equal to one half of a frame cycle.

36. The driving method as set forth in claim 35, wherein:

a time period required for scanning the first display section and a time period required for scanning the second display section are respectively one half of a frame period; and the first and second display sections are simultaneously scanned.

37. A data holding display apparatus, comprising:

a display panel of data holding type, which is divided into a plurality of display sections each capable of being independently driven, and into which a display signal is written into data signal lines connected to pixels of the display section that have been selected;

a plurality of data signal line driving circuits, provided for the respective display sections, for supplying the data signal line with the display signal corresponding to inputted display data; and a control circuit for supplying each of the data signal line driving circuits with either one of the display data corresponding to input image signal and interpolation display data prepared in accordance with the input image signal during at least one time period among a plurality of time periods in one cycle in a displaying of said display means, whereas supplying said each of the data signal line driving circuits with the other one of the display data and the interpolation display data during at least one other time period among the plurality of time periods.

38. A data holding display apparatus, comprising:

a display panel of data holding type for displaying a display signal, said display panel including:

a plurality of scanning signal lines;

a plurality of data signal lines provided so as to intersect with the scanning signal lines; and pixels provided in a matrix manner at respective intersections of the scanning signal lines and the data signal lines, said display panel having a display area which is divided, in a direction where the scanning signal lines are provided, into a plurality of display sections each capable of being independently driven, and in said display panel the display signal being written into data signal lines connected to pixels of the display section that have been selected, a scanning signal line driving circuit for sequentially selecting the scanning signal lines, data signal line driving circuits, provided for the respective display sections, for supplying the data signal lines with the display signal corresponding to inputted display data, and a control circuit for (a) controlling the scanning signal line driving circuit such that the scanning signal lines in the respective display sections are scanned collaterally and the scanning signal lines in the respective display sections are sequentially selected during a plurality of time periods of one cycle in a displaying of the display panel, so as to repeatedly scan the respective display sections in the one cycle as many times as the number of the time periods, and (b) supplying the data signal line driving circuits of the respective display sections with either one of the display data corresponding to an input image signal and an interpolation display data prepared in accordance with the input image signal during at least one of the time periods whereas with the other during at least one other time period.

39. A data holding display apparatus, comprising:

a display panel of data holding type for displaying a display signal, said display panel including:

a plurality of scanning signal lines;

a plurality of data signal lines provided so as to intersect with the scanning signal lines; and pixels provided in a matrix manner at respective intersections of the scanning signal lines and the data signal lines, said display panel having a display area which is divided, in a direction where the scanning signal lines are provided, into a plurality of display sections each capable of being independently driven, and in said display panel the display signal being written into data signal lines connected to pixels of the display section that have been selected, a scanning signal line driving circuit for sequentially selecting the scanning signal lines, and data signal line driving circuits, provided for the respective display sections, for supplying the data signal lines with the display signal corresponding to inputted display data, the display area being divided into first and second display sections, said data holding display apparatus, further comprising:

a control circuit for (a) controlling the scanning signal line driving circuit such that the scanning signal lines in the first and second display sections are sequentially scanned, respectively, during a first time period and a second time period that is adjacent to the first time period of one cycle in a displaying of the display panel, so as to repeatedly scan the respective first and second display sections twice in the one cycle, and (b) supplying the data signal line driving circuit of the first display section with the display data corresponding to an input image signal during the first time period whereas with an interpolation display data prepared in accordance with the input image signal during the second time period, said control circuit supplying the data signal line driving circuit of the second display section with an interpolation display data prepared in accordance with the input image signal during the first time period whereas with the display data corresponding to the input image signal during the second time period.

40. A driving method of a data holding display apparatus, comprising the steps of:

using a display panel of data holding type, which is divided into a plurality of display sections each capable of being independently driven, and into which a display signal is written into data signal lines connected to pixels of the display section that have been selected; and supplying each of the display sections with either one of the display data corresponding to input image signal and interpolation display data prepared in accordance with the input image signal during at least one time period among a plurality of time periods in one cycle in a displaying of said display panel, whereas supplying said each of the display sections with the other one of the display data and the interpolation display data during at least one other time period among the time periods.

41. A driving method of a data holding display apparatus, comprising the steps of:

using a display panel of data holding type for displaying a display signal, said display panel having a display area which is divided, in a direction where the scanning signal lines are provided, into a plurality of display sections each capable of being independently driven, and in said display panel the display signal being written into data signal lines connected to pixels of the display section that have been selected;

scanning the scanning signal lines in the respective display sections collaterally and sequentially selecting the scanning signal lines in the respective display sections during a plurality of time periods of one cycle in a displaying of the display means, so as to repeatedly scan the respective display sections in the one cycle as many times as the number of the time periods; and supplying the respective display sections with either one of the display data corresponding to an input image signal and an interpolation display data prepared in accordance with the input image signal during at least one of the time periods whereas with the other during at least one other time period.

* * * * *